United States Patent [19]

Segan et al.

[11] Patent Number: 5,047,749

[45] Date of Patent: Sep. 10, 1991

[54] PASSIVE REMOTE PHOTOELECTRIC SURVEILLANCE ALARM WITH TELESCOPIC OPTICS

[75] Inventors: Marc H. Segan, Great Barrington, Mass.; Michael R. Newsome, Jersey City; Steven M. Cohen, Hoboken, both of N.J.

[73] Assignee: Tyco Industries, Inc., Mt. Laurel, N.J.

[21] Appl. No.: 505,122

[22] Filed: Apr. 3, 1990

[51] Int. Cl.[5] ..... G08B 13/18

[52] U.S. Cl. ..... 340/555; 250/206; 250/221

[58] Field of Search ..... 340/555; 250/206, 221

[56] References Cited

U.S. PATENT DOCUMENTS

| | | | |
|---|---|---|---|
| 3,636,542 | 1/1972 | Apple | 340/555 |
| 3,842,257 | 10/1974 | Köhler | 250/221 |
| 3,932,746 | 1/1976 | Swanson | 250/221 |

*Primary Examiner*—Glen R. Swann, III

*Attorney, Agent, or Firm*—Panitch, Schwarze, Jacobs & Nadel

[57] ABSTRACT

An intruder alarm includes a circuit with a photoresistive cell located in a housing with a piezoelectric crystal sound generator and battery to power the circuit and sound generator. A telescope concentrates light from a distance in a limited field of view upon the photoresistive cell to trigger the piezoelectric crystal sound generator when light intensity on the cell changes sufficiently from an ambient light intensity level.

14 Claims, 3 Drawing Sheets

PASSIVE REMOTE PHOTOELECTRIC SURVEILLANCE ALARM WITH TELESCOPIC OPTICS

FIELD OF THE INVENTION

The invention relates to photosensitive detectors and, in particular, to a passive intruder alarm of unusually simple construction employing a single photosensitive cell.

"Active" and "passive" photosensitive intruder alarms are already known. The active systems, represented, for example, by U.S. Pat. Nos. 3,264,646, 3,680,047 and 4,433,328 require an appropriate light source as well as a sensor for operation. The advantage of such systems is that they can operate in a wide range of ambient lighting conditions, indeed, including no ambient light conditions. However, with such wide capability comes increased cost and complexity.

U.S. Pat. Nos. 4,032,777 and 4,645,919 each disclose a passive photometric device which, nevertheless, employs a pair of photosensitive elements and a reference light source operated with one of the elements to regulate the operation of the second element.

The provision of a controlled light source in an active type system and of self-adjustment to changing ambient lighting conditions in a passive system has, in the past, added greatly to the complexity and cost of such systems.

SUMMARY OF THE INVENTION

In one aspect, the invention is a photoelectric intruder alarm which comprises a power supply, indicator means for generating a discernible alarm indication when powered by the power supply, and photosensitive switch means between the power supply and the indicator means. The photosensitive switch means switches between nonconductive and conductive states for powering the indicator means with the power supply in response to changes in intensity of visible light impinging upon a photoresponsive element of the photosensitive switch means from an ambient intensity level of the visible light impinging upon the element. The alarm further comprises telescope means for concentrating visible light on the photoresponsive element.

BRIEF DESCRIPTION OF THE DRAWINGS

The foregoing summary, as well as the following detailed description of the presently preferred embodiment of the invention will be better understood when read in conjunction with the appended drawings. It should be understood, however, that this invention is not limited to the precise arrangements illustrated. In the drawings.

DETAILED DESCRIPTION OF THE PREFERRED EMBODIMENT

Figure 1:
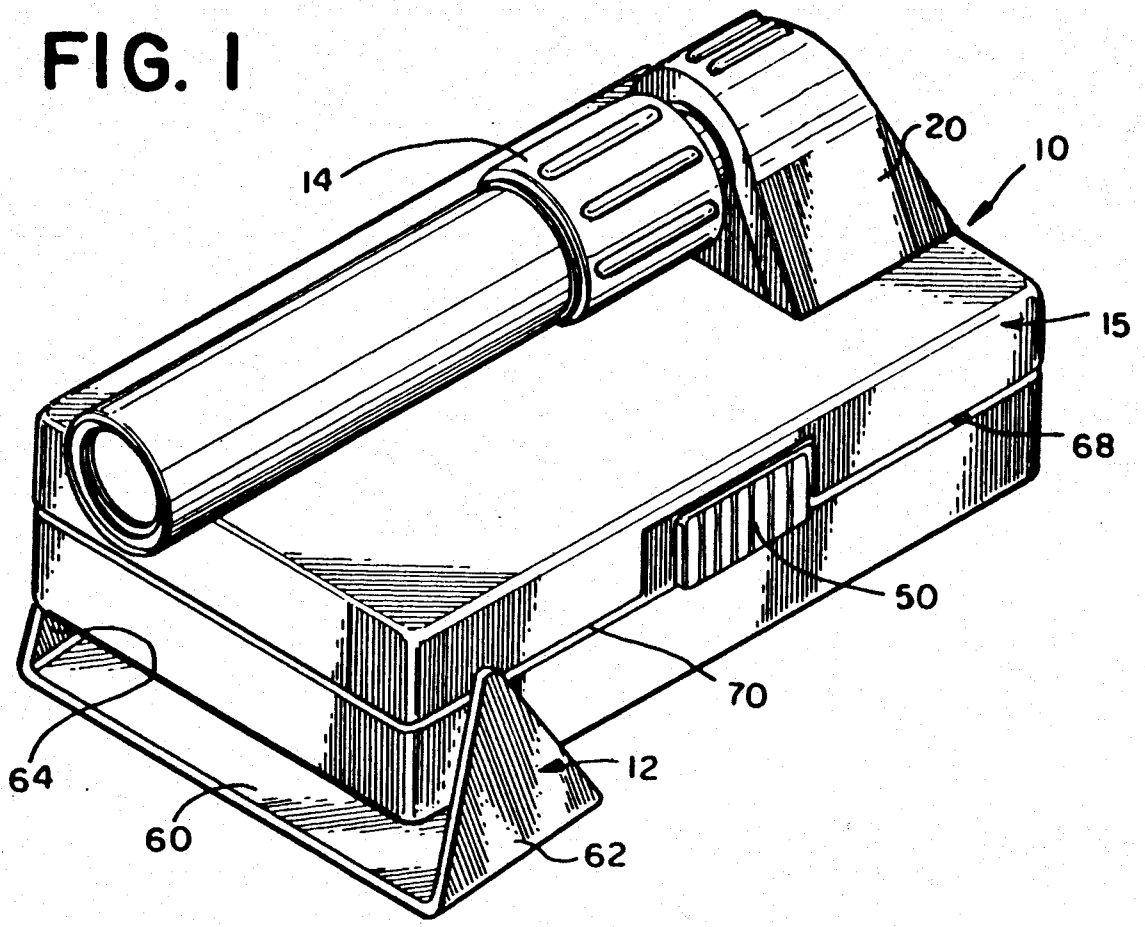
FIG. 1 is an isometric view of a preferred embodiment, self-contained, photoelectric intruder alarm.

Referring to FIG. 1, a self-contained, photoelectric intruder alarm is indicated generally at 10 and is shown with a removable and adjustable stand 12 and removable telescope means, which may be a set of optics permanently and integrally inserted in the housing or, preferably, a separate, removable telescope 14, as depicted. Stand 12 includes a base 60 and pair of arms 62 and 64 extending perpendicularly from the base. Each arm 62 and 64 includes a cylindrical tab (not seen in figures) extending perpendicularly from an inner side of the arm 62, 64 towards the remaining arm. The tabs can be received in either of two pairs of circular depressions provided proximal the "front" and "rear" ends of the alarm housing indicated generally at 15. One such circular depression, proximal the rear of housing 15, is depicted at 68. Alternatively or in addition, the tabs can be received in slots, like slot 70 extending longitudinally along opposing sides of the housing 15, so as to permit the stand to be positioned adjustably along the longitudinal sides of the housing 15 and essentially continuous adjustment of the pitch of the housing over a range.

Figure 2:
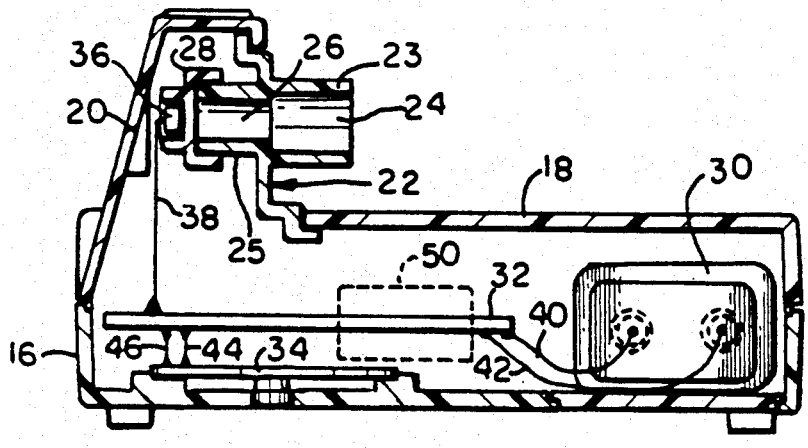
FIG. 2 is a section side elevation of the device of FIG. 1 with an adjustable stand and telescope seen in FIG. 1 removed.

Referring to FIG. 2, the device 10 is illustrated diagrammatically from the side with the stand 12 and telescope 14 removed and housing 15 sectioned. The housing 15 contains the electronic components of the device. The housing 15 preferably includes a housing bottom 16 and a housing top 18 received upon and interfitting with the bottom 16. A hollow tower, indicated at 20, is preferably integrally provided at a "rear" end of the housing top 18 and includes an aperture on a "forward" side of the tower 20 receiving an insert 22. The insert 22 includes an outer cylindrical portion 23 and a central bore 24, which is exposed outside the remainder of the housing, and an inner cylindrical portion 25 with a smaller central bore 26 concentric with the bore 24. The innermost end of the smaller central bore 26 is preferably capped with a transparent cover 28.

Preferably, the housing 15 contains a power supply in the form of a 9-volt battery 30, a printed circuit board 32 mounting most of the electronic components of the device and a piezoelectric crystal acoustic element 34. A single photoresponsive element, preferably a cadmium sulfide (CdS) thin film photoconductive (photoresistive) cell 36, is supported on leads 38 (only the near lead being seen in FIG. 2) so as to be approximately centered coaxially with the central bores 24 and 26 behind and generally against the transparent transverse web of cover 28. In this way, the photosensitive surface of the cell 36 is located at a known position for interaction with the telescope 14 and is protected if the telescope 14 is removed from the housing 15. The bores 24 and 26 and transverse web of transparent cover 28 effectively form an aperture through the housing 15 which provides a limited field of view to the photoresistive cell 36 within the housing to light from outside the housing 15. Telescope 14 effectively further limits that field of view. The photoresistive cell 36 is exposed to ambient light outside the housing 15 only within the limited field of view provided through that aperture or the telescope 14 when the latter is mounted to the housing. Also visible in FIG. 2 are leads 40 and 42 coupling the battery 30 with the circuit supported on the printed circuit board 32 and leads 44 and 46 coupling the circuit on the printed circuit board 32 with the piezoelectric crystal element 34. The piezoelectric crystal element 34 may be any of a variety of commercially available elements designed specifically for buzzer or alarm applications. The element 34 is supported on a plurality of lands 48 which project upwardly from the lower inner surface of the housing bottom 16. The printed circuit board 32 is preferably positioned between lands and shoulders provided on the facing sides of the housing bottom 16 and top 18. The lands and shoulders are not shown in the drawings for simplicity. A power switch cover 50, also seen in FIG. 1, is depicted in phantom. It overlies the slideable arm of a single pole single throw power switch 110 seen in FIG. 3, which forms part of the electronic circuit.

Figure 3:
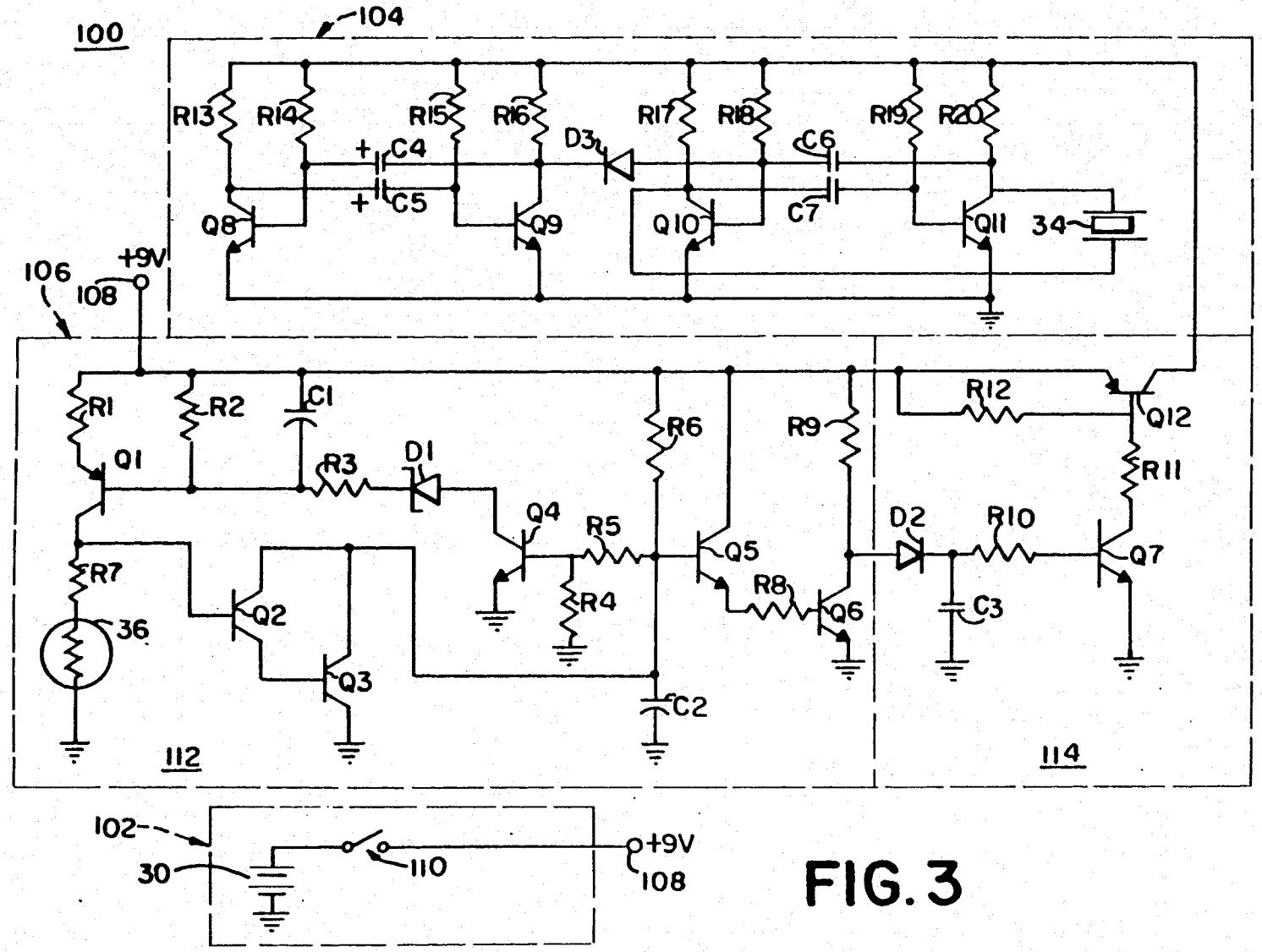
FIG. 3 is a circuit diagram of the electronic components of the device of FIGS. 1 and 2.

FIG. 3 is a diagram of the electronic circuit 100 of the alarm 10. The electronic circuit 100 includes three major subcircuits: a power supply subcircuit indicated generally at 102, an indicator subcircuit indicated generally at 104, and a photosensitive switch subcircuit, indicated generally at 106. The indicator subcircuit 104 generates a discernible alarm indication when powered by the power supply subcircuit 102. The switch subcircuit 106 is located between the power supply subcircuit 102 and the indicator subcircuit 104. The photosensitive switch subcircuit 106 switches between nonconductive and conductive states in response to changes in intensity of visible light impinging upon the photoresponsive element 36.

The power supply subcircuit 102 includes the battery 30 and the ON-OFF power switch 110, operated through the slideable cover 50 (shown in FIG. 1), to activate and turn off the device 10. The power supply subcircuit 102 provides a current source at node 108 to power the other two subcircuits 104 and 106.

The photosensitive switch subcircuit 106 includes the photoresisitive cell 36, capacitors C1–C3, Zener diode D1, diode D2, resistors R1–R12 and transistors Q1–Q7 and Q12. The preferred cadmium sulfide cell 36 decreases its resistance in response to increased intensity of impinging visible light. The cadmium sulfide cell 36 is the only photoresponsive element provided in the photosensitive switch subcircuit 106 and in the entire alarm 10.

The photosensitive switch subcircuit 106 has two sections, a normally powered, optical section, indicated at 112, and a normally unpowered, power up section, indicated at 114. The optical section 112 includes a transistorized current control between the current source node 108 and the cadmium sulfide cell 36 in the form of a first transistor Q1, preferably a PNP transistor, having an eroitter coupled with the current source node 108 through resistor R1 and a collector coupled with the cadmium sulfide cell 36 through a resistor R7. Coupled in parallel with the resistor R7 and cadmium sulfide cell 36 is the base of a second transistor Q2, preferably NPN. The base of a third transistor Q3, again preferably NPN, is coupled with the emitter of transistor Q2. The second and third transistors Q2 and Q3 are thus Darlington coupled forming a Darlington connected transistor pair. The Darlington connected transistor pair Q2, Q3 form a slow acting, transistorized switch which channels current from the voltage source node 108 through a load resistor R6 to circuit ground. The transistor pair Q2 and Q3 effectively form a trigger means coupled in parallel with the cadmium sulfide cell 36 for switching the photosensitive switch subcircuit 106 between nonconductive and conductive states to couple the power supply subcircuit 102 with the indicator subcircuit 104.

Current supplied through the transistor Q1 is regulated through a feedback section including a fourth transistor Q4, resistors R2 through R6, capacitor C1 and Zener diode D1. A voltage divider provided by resistors R4 and R5 and load resistor R6 maintains the base of the fourth transistor Q4, again preferably NPN, at the correct bias point to regulate the current into the base of the first transistor Q1. The feedback section supplies current through Q1 to the cadmium sulfide cell 36 and to the trigger formed by the Darlington connected transistor pair Q2 and Q3 sufficient to maintain Q2 and Q3 at the threshold of their respective conducting states. The feedback section formed by elements C1, D1, Q4 and R2 through R6 is sufficiently slow acting that current through Q1 is adjusted automatically to account for all changes in ambient light levels which occur naturally throughout the day, for example, in passing from darkness to daylight and back to darkness again. However, the feedback section does not act quickly enough to adjust the current through Q1 to account for sudden light level changes that would be caused by non-ambient conditions such as the movement of dark objects or shadows into the field of view of the cadmium sulfide cell 36. Non-ambient refers to an other than naturally occurring change in light. Consequently, the resistance of the cadmium sulfide cell 36 will suddenly increase due to the sudden drop in intensity of visible light impinging upon that element, caused by an other than naturally occurring change in the ambient visible light impinging upon that cell 36, and the Darlington connected pair Q2 and Q3 will go conductive switching the subcircuit 106 as a whole conductive. This switches circuit 106 conductive between current source node 108 of the power supply subcircuit 102 and the indicator circuit 104.

The cell 36 may be a type VT-932, for example. Such a cell 36 is nonlinear and responds to visible light, i.e. light in the visible spectrum. A one to ten percent increase in cell 36 resistance, caused by a drop in the visible light intensity impinging upon the cadmium sulfide cell 36 from an ambient intensity level, is sufficient to directly trigger the switch of the Darlington pair Q2, Q3 to conducting states. The cell 36 responds more rapidly at higher incident light intensity levels. In the case of a sudden increase in intensity of incident visible light on cell 36, the circuit 106 will adjust to the new, higher light level and the pair Q2 and Q3 will trigger when the light on cell 36 drops back down to the former ambient level. In this way, the circuit 106 will trigger in response to nonambient increases and decreases in visible light intensity from an ambient, visible light intensity level.

Switching is accomplished through transistors Q5, Q6, Q7 and Q12. Current is actually passed from the current source node 108 to the indicator subcircuit 104 through transistor Q12, again preferably PNP. Under normal circumstances, transistors Q2, Q3, Q7 and Q12 are nonconducting while transistors Q1, Q4, Q5 and Q6 are conducting. When transistors Q2 and Q3 change state from nonconducting to conducting due to a nonambient changes in the intensity level of visible light impinging upon cadmium sulfide cell 36, Q5 is rendered nonconducting which, in turn, renders normally-conducting Q6 nonconducting. When Q6 is rendered nonconductive, its collector goes high which causes capacitor C3 to charge through diode D2 rendering transistor Q7 conductive, in turn rendering transistor Q12 conductive. When Q2 and Q3 transition back to nonconductive states, transistors Q5 and Q6 transition back to conducting states. However, because of the presence of diode D2, C3 maintains its charge and transistors Q7 and Q12 remain in conducting states until the charge of capacitor C3 is drained through Q7 to a sufficiently low state to shut off transistor Q7. By using the power-up section feature, the overall circuitry 100 draws less than twenty microamps of current until a trigger condition occurs. This makes the alarm 10 practical for long-term surveillance.

The indicator means subcircuit 104 is activated by current from source 108 once transistor Q12 is rendered conductive. Preferably, the indicator subcircuit 104 includes capacitors C4–C7, diode D3, resistors R13–R20, transistors Q8-Q11 and piezoelectric crystal 34. An audio tone generator is formed by capacitors C6, C7, transistors Q10, Q11, resistors R17 through R20 and a piezoelectric crystal element 34. These elements are configured as a relatively high pitch piezoelectric crystal driver oscillating the piezoelectric crystal 34 at an audible frequency, e.g. 2800 Hz. In particular, the piezoelectric crystal 34 is operated in a push-pull mode between the collectors of the two transistors Q10 and Q11. A chopper section is provided by capacitors C4, C5, diode D3, transistors Q8 and Q9 and resistors R13–R16. These elements form a relatively low frequency/low pitch multivibrator oscillator which kills the oscillation of the piezoelectric crystal 34 through the diode D3 to create a pleasing chopping effect on the high frequency auditory beep generated by the piezoelectric crystal 34. While an auditory indicator is used, a visual indicator such as a flashing diode or the like may be alternately or additionally used. Moreover, while the power up section 112 is provided to drive the indicator subcircuit 104, one of ordinary skill will appreciate that a triggerable, integrated sound generation circuit, which activates automatically in response to a trigger pulse for self-timed operation, might be substituted.

Figure 4:
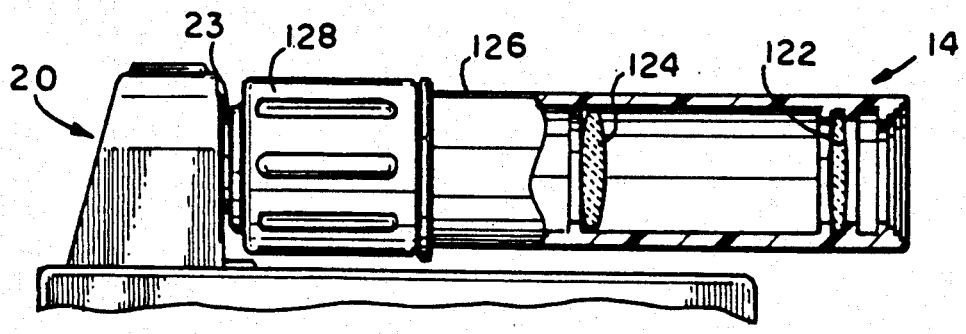
FIG. 4 is a partially broken away, partial side elevation of the device of FIG. 1 showing the construction of the telescope.

FIG. 4 depicts further details of the telescope 14. Preferably, the telescope 14 is of a Galilean design with an objective lens 122 and an eyepiece lens 124 mounted in a hollow, tubular housing 126. Lenses 122 and 124 are selected and positioned to gather or collect visible light from a limited field of view of a distant image or scene and to concentrate that collected visible light on the cell 36. Preferably, the eyepiece end 128 of the telescope 14 includes a bore (not depicted) sized slightly larger than the cylindrical portion 23 of insert 22 to be frictionally received on that cylindrical portion 23 to couple the telescope 14 to the housing of the device 10. Making telescope 14 removable permits the user to remove it from the device 10 and frame the image the cell 36 will see so that the device 10 can be properly spaced from the area under surveillance for the type of intrusion being sensed. For example, the device 10 can be spaced farther away to sense large objects such as vehicles than it should be spaced to sense smaller objects such as people.

Preferably, the telescope 14 is 4× having about a 2° circular field of view with a 16 mm. planoconvex objective lens 122 with about a 96 mm. focal length and a 13 mm. plano-concave eyepiece lens 124 with about a −27 mm. focal length. Without the telescope 14, the light falling upon the cell 36 would be so diffused and from so large an area that the device 10 would not be able to respond to objects passing its field of view more than a foot or a few feet from the device. The telescope 14 collects visible light from a relatively small field of view (about 2°) of a distant scene or image and concentrates that light upon the cell 36, thereby providing a means for making the device responsive to the passage of a person and other objects farther away from the device 10 than could possibly be detected by the device 10 without the telescope 14.

While the preferred embodiment has been described and various modifications thereto suggested, one of ordinary skill in the art will appreciate that additional changes may be made to the above-described embodiment without departing from the broad, inventive concepts thereof. Accordingly, the scope of the invention is indicated by the appended claims rather than the foregoing specification.

We claim:

1. A passive remote photoelectric surveillance alarm comprising:

a power supply;

indicator means for generating a discernible alarm indication when powered by the power supply;

photosensitive switch means between the power supply and the indicator means, the photosensitive switch means switching between nonconducting and conducting states for powering the indicator means with the power supply at least in response to non-naturally occurring changes in intensity of ambient visible light impinging upon a photoresponsive element of the switch means and the photosensitive switch means automatically self-adjusting for preventing the powering of the indicator means in response to naturally occurring changes in the intensity of the ambient visible light impinging upon the photoresponsive element; and telescope means for concentrating visible light on the photoresponsive element.

2. The alarm of claim 1 wherein the photoresponsive element is a single photoresistive cell, the cell being the only photoresponsive element in the alarm.

3. The alarm of claim 1 wherein the photoresponsive element is a photoresistive cell and wherein the photosensitive switch means further comprises:

trigger means coupled with the photoresistive cell for switching between two states in responsive to changes in resistance i the photoresistive cell; and transistorized current means between the power supply and the photoresistive cell for supplying current to the photoresistive cell sufficient to maintain the trigger means at a threshold of switching from one to the other state under the ambient light intensity level impinging upon the photoresistive cell and to cause the trigger means to switch states when the visible light intensity level impinging upon the photoresistive cell changes sufficiently from the ambient light intensity level that had been impinging upon the cell.

4. The alarm of claim 3 wherein the transistorized current means comprises a first transistor having a first side coupled with the current source and a second side coupled in parallel with the photoresistive cell and the trigger means.

5. The alarm of claim 4 wherein the trigger means comprise a second transistor having a base coupled with the second side of the first transistor.

6. The alarm of claim 5 wherein the trigger means comprises a third transistor coupled in a Darlington pair with the second transistor.

7. The alarm of claim 4 wherein the transistorized current means further comprises a Zener diode coupled with the base of the first transistor.

8. The alarm of claim 7 further comprising damping means between the current source and the Zener diode for damping oscillations in current supplied to the Zener diode and the first transistor base from the current source.

9. The alarm of claim 3 wherein the trigger means comprises transistor means having a base coupled with the transistorized current means to switch from a nonconductive state to a conductive state with a change in light level impinging upon the photoresistive cell from an ambient light level.

10. The device of claim 3 wherein the trigger means comprises a Darlington connected pair of transistors.

11. The alarm of claim 3 wherein the photosensitive switch means comprises transistor means having a first side coupled with the current source and a second side coupled with the indicator means, the state of the transistor means being controlled by the state of the trigger means.

12. The alarm of claim 1 wherein the indicator means comprises an audio tone generator.

13. The alarm of claim 12 wherein the audio tone generator comprises a crystal oscillator.

14. A photoelectric intruder alarm comprising:

a power supply;

indicator means for generating a discernible alarm indication when powered by the power supply;

photosensitive switch means between the power supply and the indicator means, the photosensitive switch means switching between nonconducting and conducting states for powering the indicator means with the power supply in response to changes in intensity of visible light impinging upon a photoresponsive element of the switch means from an ambient intensity level of visible light impinging upon the element;

a telescope concentrating visible light on the photoresponsive element; and housing means for enclosing the photosensitive switch means, the housing means being adapted to removably receive the telescope and including an aperture positioned with respect the telescope and the photoresponsive element to expose the photoresponsive element light form the telescope.

* * * * *